US009530368B2

(12) United States Patent
Lee et al.

(10) Patent No.: US 9,530,368 B2
(45) Date of Patent: Dec. 27, 2016

(54) DISPLAY DEVICE

(71) Applicant: LG DISPLAY CO., LTD., Seoul (KR)

(72) Inventors: SungGae Lee, Gunpo-si (KR); Dong-Woo Lee, Chungcheongnam-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/552,083

(22) Filed: Nov. 24, 2014

(65) Prior Publication Data

US 2015/0145758 A1 May 28, 2015

(30) Foreign Application Priority Data

Nov. 25, 2013 (KR) ..... 10-2013-0144113

(51) Int. Cl.
*G09G 3/36* (2006.01)

(52) U.S. Cl.
CPC ..... *G09G 3/3648* (2013.01); *G09G 3/3614* (2013.01); *G09G 3/3696* (2013.01); *G09G 2320/0257* (2013.01); *G09G 2320/0276* (2013.01); *G09G 2320/0673* (2013.01); *G09G 2330/021* (2013.01)

(58) Field of Classification Search
CPC ..... G09G 3/3614; G09G 2320/0276
See application file for complete search history.

(56) References Cited

U.S. PATENT DOCUMENTS

2006/0114207 A1* 6/2006 Lee ..... G09G 3/3648 345/89
2007/0229442 A1* 10/2007 Yi ..... G09G 3/3688 345/100
2007/0236379 A1* 10/2007 Lee ..... G09G 3/3688 341/144
2008/0309687 A1* 12/2008 Choi ..... G09G 3/3648 345/698
2012/0194575 A1 8/2012 Yen et al.
2013/0127804 A1* 5/2013 Kim ..... G09G 3/3648 345/211
2015/0070405 A1* 3/2015 Lee ..... G09G 3/3696 345/690

FOREIGN PATENT DOCUMENTS

CN 103377623 A 10/2013

* cited by examiner

*Primary Examiner* — Gerald Johnson
(74) *Attorney, Agent, or Firm* — Dentons US LLP

(57) ABSTRACT

Disclosed is a display device configured to decrease power consumption. The device comprises a display panel having a plurality of data lines and gate lines crossing in a matrix form, wherein a pixel is defined at each crossing thereof; a data driver connected to the plurality of data lines and supplying analog data voltages converted from digital data voltages to odd data lines and even data lines respectively according to an odd gamma reference voltage and an even gamma reference voltage; a gamma generator outputting one of a positive gamma reference voltage and a negative gamma reference voltage as the odd gamma reference voltage, and one of the positive gamma reference voltage and the negative gamma reference voltage as the even gamma reference voltage to the data driver; and a timing controller generating a control signal for driving the display panel.

9 Claims, 9 Drawing Sheets

DISPLAY DEVICE

This application claims benefit under 35 U.S.C. §119(a) to Korean Patent Application No. 10-2013-0144113, filed on Nov. 25, 2013, which is hereby incorporated by reference for all purposes as if fully set forth herein.

BACKGROUND OF THE INVENTION

Field of the Invention

The present invention relates to a display device to display an image.

Description of the Related Art

As an information oriented society has developed, demands for displays to display an image are increasing. Thus, various flat displays such as a liquid crystal display (LCD), plasma display panel (PDP), and organic light emitting display (OLED) have been used recently.

In order to decrease a DC offset component and reduce degradation of the liquid crystal, the liquid crystal display performs an inversion driving in which a polarity between adjacent liquid crystals is inverted per frame period.

In the display device of the inversion driving, a voltage transition is relatively large so that the power consumption is increased.

SUMMARY OF THE INVENTION

The present detailed description has been made to solve the above-mentioned problems in the related art, and an aspect of the present disclosure is to supply a display device in which the overall power consumption may be minimized.

In accordance with an aspect of the present embodiment, a display device may comprise a display panel in which a plurality of data lines and gate lines is intersected in a matrix form and a pixel is defined at every intersections thereof, a data driver for being connected to the plurality of data lines and supplying analog data voltages converted from digital data voltages into odd data lines and even data lines respectively according to an odd gamma reference voltage and an oven gamma reference voltage, a gamma generator for outputting any one of a positive gamma reference voltage and a negative gamma reference voltage as the odd gamma reference voltage and any one of the positive gamma reference voltage and the negative gamma reference voltage as the even gamma reference voltage to the data driver and a timing controller for generating a control signal for driving the display panel which comprises a selection signal to select one of the positive gamma reference voltage and the negative gamma reference voltage at the gamma generator.

In accordance with other aspect of the present embodiment, a display device may comprise a display panel in which a plurality of data lines and gate lines is intersected in a matrix form and a pixel is defined at each of intersections thereof, a data driver for being connected to the plurality of data lines and supplying analog data voltages converted from digital data voltages into odd data lines and even data lines respectively according to an odd gamma reference voltage and an oven gamma reference voltage, a gamma generator for generating a first gamma reference voltage and a second gamma reference voltage equal to or different from each other as a gamma reference voltage according to setting data for the gamma reference voltage and outputting the first gamma reference voltage as the odd gamma reference voltage and the second gamma reference voltage as the even gamma reference voltage to the data driver and a timing controller generating a control signal for driving the display panel.

As described above, the various present embodiments can minimize the overall power consumption in the display device.

DETAILED DESCRIPTION OF THE ILLUSTRATED EMBODIMENTS

Figure 1:
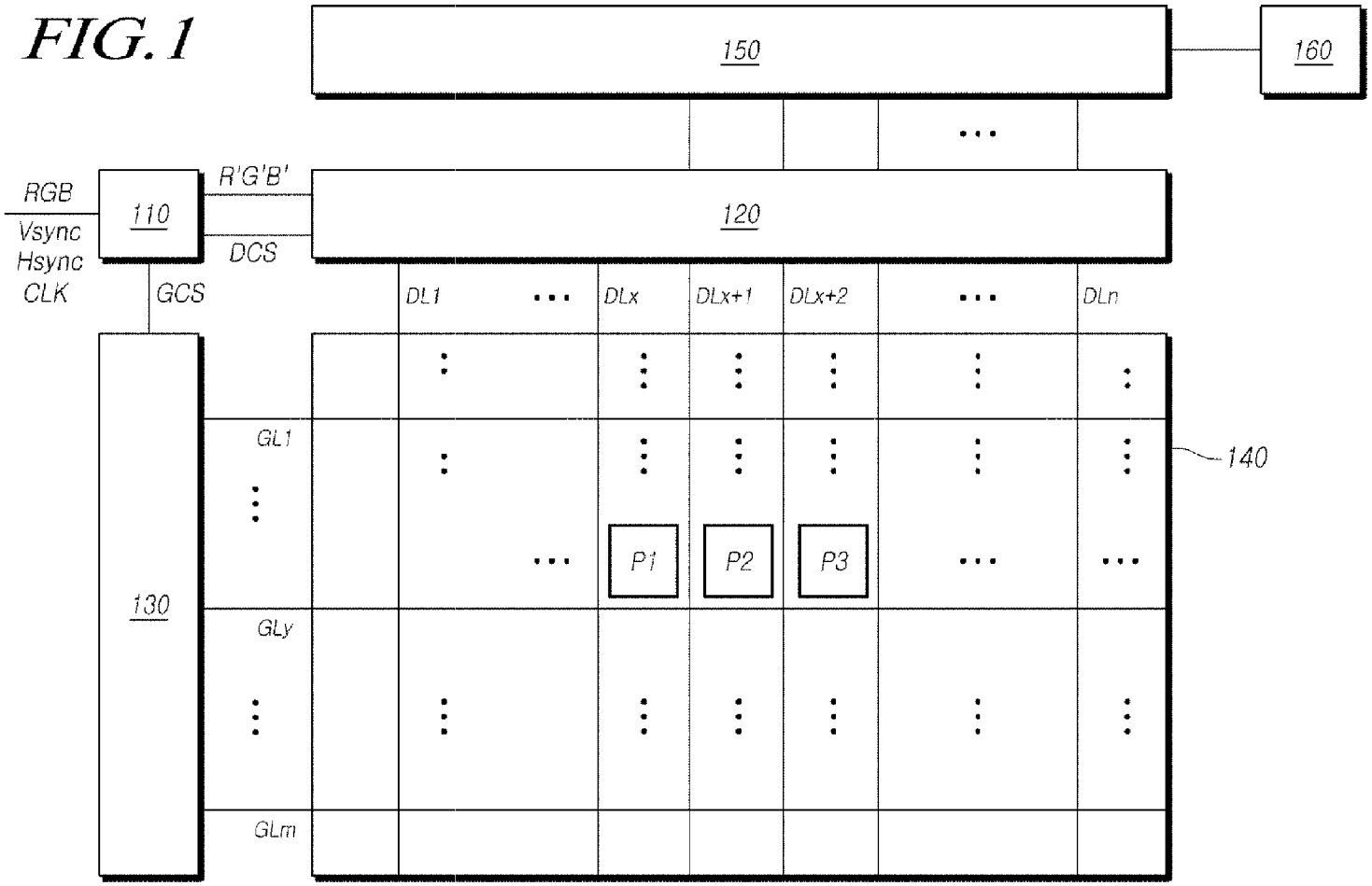
FIG. 1 illustrates a system configuration of a liquid crystal display device as an example of a display device to which various embodiments is applied.

Hereinafter, exemplary embodiments of the present invention will be described with reference to the accompanying drawings. In the following description, the same elements will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. Each of these terminologies is not used to define an essence, order sequence or number of a corresponding component but used merely to distinguish the corresponding component from other component(s). It should be noted that if it is described in the specification that one component is "connected," "coupled" or "joined" to another component, a third component may be "connected," "coupled," and "joined" between the first and second components, although the first component may be directly connected, coupled or joined to the second component.

FIG. 1 illustrates a system configuration of a liquid crystal display device as an example of a display device to which various embodiments is applied.

Referring to FIG. 1, a liquid crystal display device 100 to which various embodiments is applied may include a timing controller 110 for controlling driving of a display panel 140, a data driver 120, and a gate driver 130.

The timing controller 110 generates control signals using a timing synchronization signal such as a horizontal synchronization signal Hsync, a vertical synchronization signal Vsync, a clock signal CLK and a data enable signal DE applied from an external system. The control signals may include a gate control signal GCS for controlling operation timings of the gate driver 130 and a data control signal DCS for controlling the operation timing of the data driver 120. The timing controller 110 generates a gamma control signal which is necessary for generating and supplying a gamma reference voltage to the data driver 120.

The timing controller 110 rearranges digital video data RGB received from the external system and supplies the rearranged digital video data R'G'B' to the data driver 120.

The horizontal synchronization signal Hsync and the vertical synchronization signal Vsync are synchronization signals for synchronizing a display signal. The horizontal synchronization signal Hsync is a signal for distinguishing a frame and is input per frame. The vertical synchronization signal Vsync is a signal for distinguishing a gate line within one frame and is input per one gate line. The data enable signal DE displays an interval with valid data and indicates a point to supply data to the pixel. The horizontal synchronization signal Hsync, the vertical synchronization signal Vsync and the data enable signal DE operate based on the click signal CLK.

The gate control signals GCS may include a gate start pulse GSP, a gate shift clock signal GSC, a gate output enable signal GOE and the like. The gate start pulse GSP controls the timing of a first gate pulse. The gate shift clock GSC is a clock signal for shifting the gate start pulse GSP. The gate output enable signal GOE controls an output timing of the gate driver 130.

The data control signals DCS may include a source start pulse SSP, a source sampling clock SSC, a source output enable signal SOE, a polarity control signal POL and the like. The source start pulse SSP controls a data sampling start point of the data driver 120 in one horizontal line. The source sampling clock SSC is a clock signal for controlling a data sampling operation of the data driver 120 based on a rising or falling edge. The source output enable signal SOE controls an output timing of the data driver 120. The polarity control signal POL controls the polarity of the data voltages output from the data driver 120 and supplied to the liquid crystal cells Clc.

The data driver 120 may sample and latch the digital video data R'G'B' received from the timing controller 110 in response to the data control signal DCS and convert the latched digital video data R'G'B' into an positive/negative analog data voltage using positive and negative gamma reference voltages and generate positive and negative analog video data voltages to be supplied to the liquid crystal cells Clc. The data driver 120 may invert polarities of the positive and negative analog video data voltages in response to the polarity control signal POL and supply the inverted data voltages to the data lines DL1 to DLn.

The gate driver 130 may include a shift register, a level shift for converting an output signal of the shift register into a signal with a swinging width suitable for driving a driving transistor of the liquid crystal cell, and an output buffer connected between the level shift and the gate line. The gate driver 130 may sequentially output the gate signals with a pulse width of one horizontal interval to the gate lines GL1 to GLm in response to the gate control signal GDC.

In the display panel 140, a plurality of data lines and gate lines are crossed in a matrix form and a pixel is defined at each crossing thereof.

More specifically, the n number of data lines DL1~DLn and the m number of gate lines GL1~GLm are crossed on the first substrate of the display panel 140. The m×n (m, n is a positive integer) of liquid crystal cells Clc are formed at each crossing thereof in a matrix form on the first substrate of the liquid crystal display panel 140. Each liquid crystal cell Clc formed at each crossing cell may include a driving transistor, a pixel electrode connected to one of a source electrode and a drain electrode of the driving transistor, a common electrode and a storage capacitor Cst.

A black matrix and a color filter may be formed on the second substrate of the liquid crystal display panel 140. The common electrode may be formed on the second substrate in the manner of the vertical electric field such as a twisted nematic (TN) mode or a vertical alignment (VA) mode and the like. The common electrode may be formed on the first substrate in the manner of the horizontal electric field such as an in plane switching (IPS) mode, a fringe field switching (FFS) mode and the like. The polarizer may be attached to each of the upper and the lower substrates. And the alignment layer may be formed on each of the upper and the lower substrates for setting a pre-tilt angle. In addition, the black matrix and the color filter may be formed on the first substrate of the liquid crystal display panel 140.

The liquid crystal is interposed between the first substrate and the second substrate in the liquid crystal display panel 140.

Figure 2:
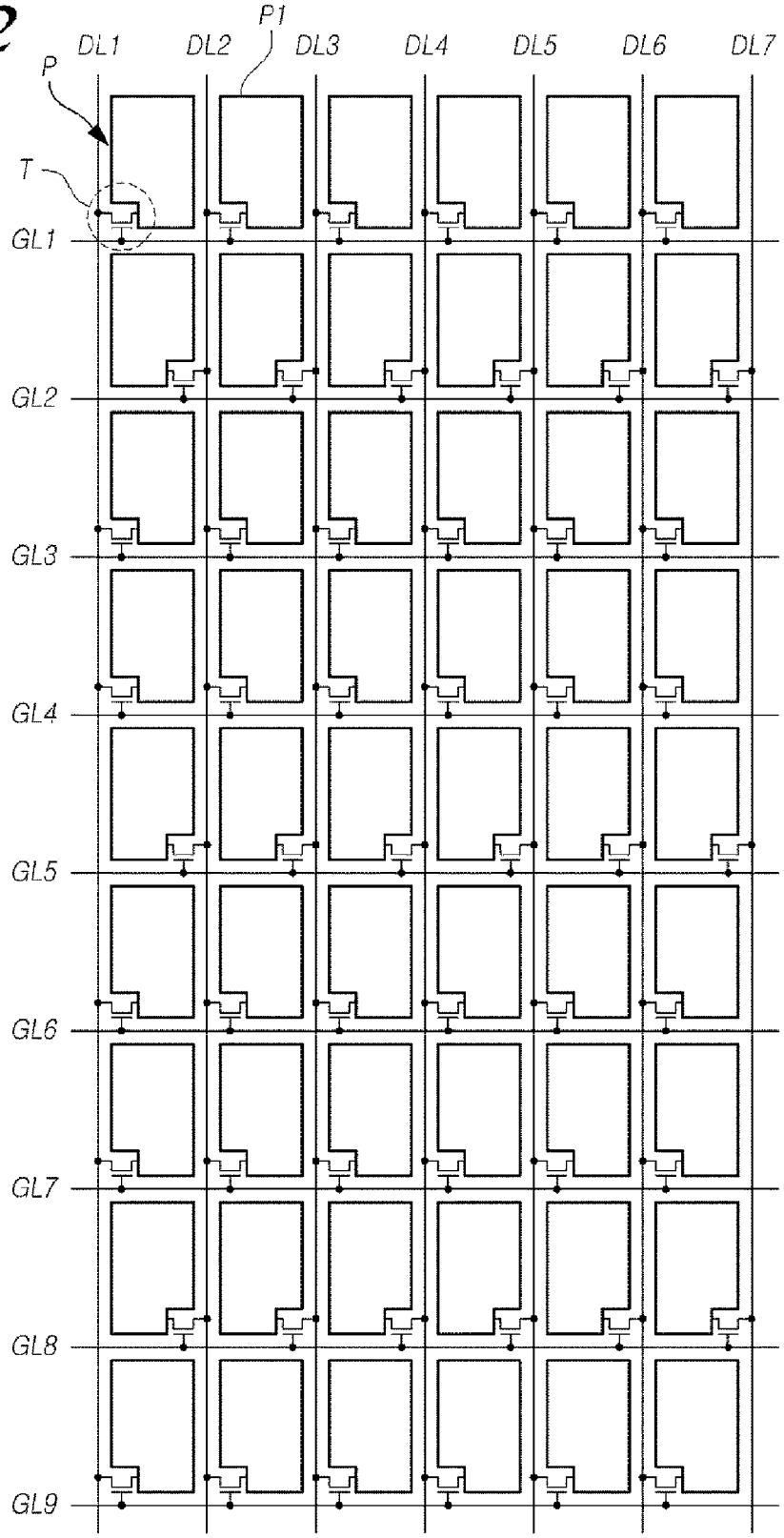
FIG. 2 illustrates one example of a pixel structure of the liquid crystal display device in FIG. 1.

FIG. 2 illustrates one example of a pixel structure of the liquid crystal display device in FIG. 1.

Referring to FIG. 2, as one example of a pixel structure of the liquid crystal display device, the pixels connected to the same data line may be disposed in turn at one of both sides of the corresponding data line in the vertical direction. For example, the pixels connected to the second data line may be the second pixel P2 at odd horizontal lines while being the first pixel P1 at even horizontal lines.

Referring FIG. 1 again, the gamma generator 150 may generate the gamma reference voltages with a power voltage from the power supplier 160. The gamma generator 150 may generate a plurality of the gamma reference voltages corresponding to a plurality of gray levels and apply them to the data driver 120.

The gamma generator 150 may be configured by a programmable power integrated circuit PPIC. The gamma generator 150 may be included in either the data driver 120 or the timing controller 110. Some elements of the gamma generator 150 may be included in either the data driver 120 or the timing controller 110. The gamma generator 150 according to various embodiments will be described below with reference with FIGS. 6 to 9.

The power supplier 160 may generate multiple values of voltages for driving components of the liquid crystal display device 100 with the power supplied from the external system. The power supplier 160 may supply the generated voltages to components of the liquid crystal display device 100.

The gamma generator 150 and the power supplier 160 may be embodied as one integrated circuit.

The liquid crystal display device 100 may be necessary for the inversion driving of the liquid crystal in order to improve image retention. The inversion driving is to apply one of a positive value and a negative value of the voltage in turn to each frame period so that the residual voltage to the liquid crystal may be substantially zero and the image retention may be reduced. However because the voltage transition or the data transition between the positive value and the negative value happens very often, the power consumption for driving of the liquid crystal display device may be increased very much.

Figure 3:
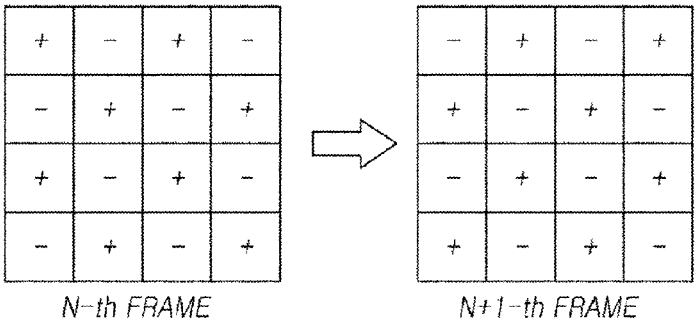
FIG. 3 illustrates a dot inversion driving scheme.
Figure 4:
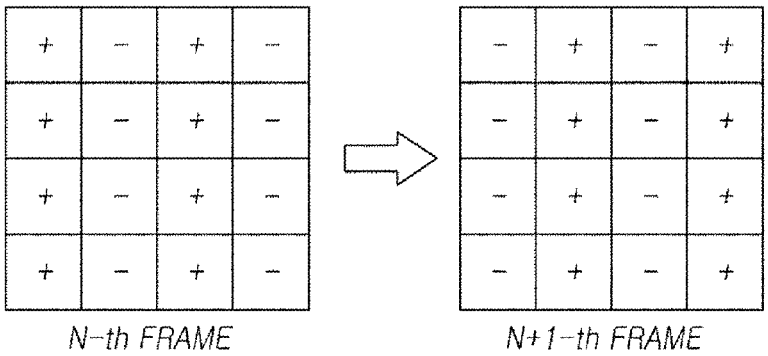
FIG. 4 illustrates a column inversion driving scheme.
Figure 5:
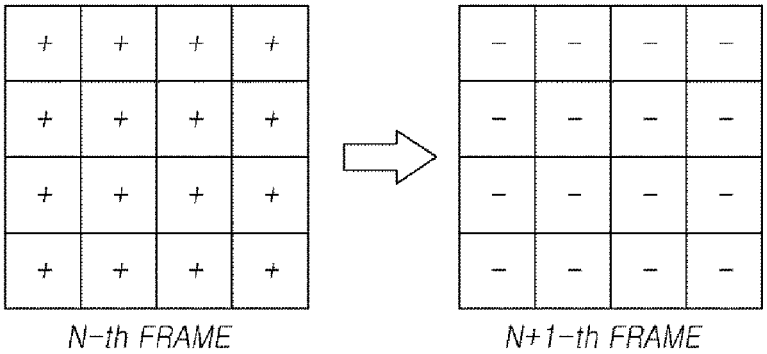
FIG. 5 illustrates a frame inversion driving scheme.

FIG. 3 illustrates a dot inversion driving scheme. FIG. 4 illustrates a column inversion driving scheme. FIG. 5 illustrates a frame inversion driving scheme. The inversion driving control of the liquid crystal may be either a dot inversion driving control or a column inversion driving control as shown in FIGS. 3 and 4. In the dot inversion driving control as shown in FIG. 3, the polarities of the data voltages applied to adjacent pixels are opposite to each other and are inverted to the opposite values per the frame. Although the 1-dot inversion is described above as the dot inversion, a multi-dot inversion such as 2-dot, 3-dot inversion and the like may be included in this embodiment. In the column inversion driving control as shown in FIG. 4, the polarities of the data voltages applied to adjacent pixels respectively disposed at adjacent column lines are opposite to each other and are inverted to the opposite values per the frame. In the present disclosure, the column inversion may be referred to as the row inversion in which the polarities of the data voltages applied to adjacent pixels respectively disposed at adjacent row lines is opposite to each other and is inverted to the opposite values per the frame.

The dot and the column inversion driving controls show excellent characteristics in view of image quality while these make the power consumption to be increased because the voltage transition happens very often.

In the frame inversion driving as shown in FIG. 5, the polarities of the data voltages applied to all pixels are equal to each other and are inverted to the opposite values per the frame. Accordingly the frame inversion driving control shows excellent characteristics in view of the power consumption because the polarities of the data voltages applied to all pixels are equal to each other in one frame and are inverted to the opposite values in the next frame, thereby minimizing the voltage transition.

Figure 6:
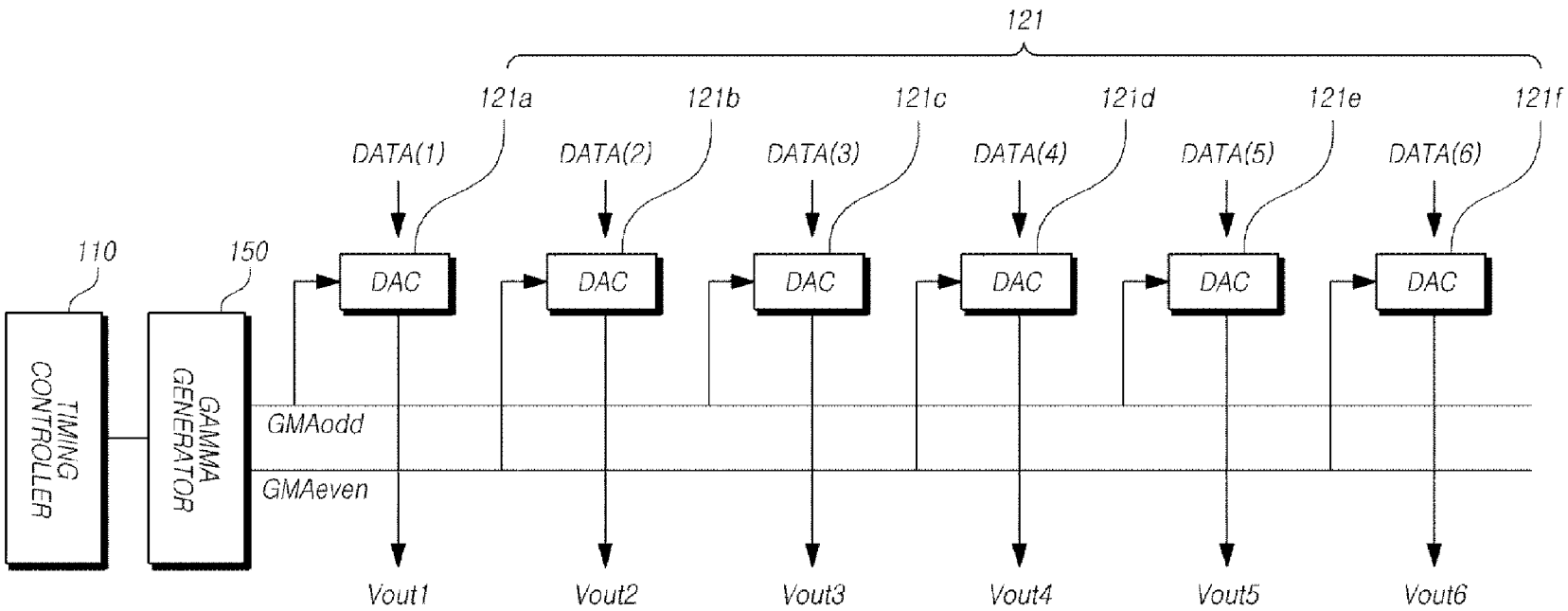
FIG. 6 illustrates the timing controller, the gamma generator and some elements of the data driver in FIG. 1.

FIG. 6 illustrates the timing controller, the gamma generator and some elements of the data driver 120 in FIG. 1.

Referring to FIGS. 1 and 6, the data driver 120 may supply, to the data lines DL1 to DLn, the positive/negative analog data voltages Vout1, Vout2, Vout3, Vout4, Vout5, Vout6, . . . , Voutn generated from the digital video data R'G'B' in response to the polarity control signal POL through a digital analog convertor part (DAC part) 121. The DAC part 121 may include a plurality of DACs such as odd DACs 121*a*, 121*c*, 121*e* and even DACs 121*b*, 121*d*, 121*f* as shown in FIG. 6.

The data driver 120 may supply the analog data voltages converted from the digital video data to the odd data lines and the even data lines respectively according to an odd gamma reference voltage GMAodd and an even gamma reference voltage GMAeven.

The gamma generator 150 may generate the plurality of gamma reference voltages with the power voltage from the power supplier 160 according to the gamma control signal. The gamma generator 150 may apply the generated gamma reference voltages to the data driver 120. More specifically, the gamma generator 150 may selectively output, according to the gamma control signal, the odd gamma reference voltage GMAodd and the even gamma reference voltage GMAeven to the odd DACs 121*a*, 121*c*, 121*e*, . . . , Voutn−1 and the even DACs 121*b*, 121*d*, 121*f*, . . . , Voutn respectively.

The odd DACs and the even DACs may convert the digital video data into the data voltages Vout1, Vout3, Vout5, . . . , Voutn−1, Vout2, Vout4, Vout6, . . . , Voutn using the odd gamma reference voltage GMAodd and the even gamma reference voltage GMAeven applied from the gamma generator 150, which are supplied to the odd data lines DL1, DL3, . . . DLn−1 and the even data lines DL2, DL4, . . . , DLn respectively. In this case, the polarities of the odd gamma reference voltage GMAodd and the even gamma reference voltage GMAeven are opposite to each other.

Accordingly, it is impossible for the data driver 120 as shown in FIG. 6 to embody the frame inversion driving. In other words, in order to embody the frame inversion driving, the data driver 120 must be redesigned so that the redesigned data driver may lead to increase the cost and the time of the production thereof.

The liquid crystal display device which includes the data driver 120 as shown in FIG. 6 and the gamma generator 150 which is described below in reference with FIGS. 7 to 9 may embody the frame inversion driving.

Figure 7:
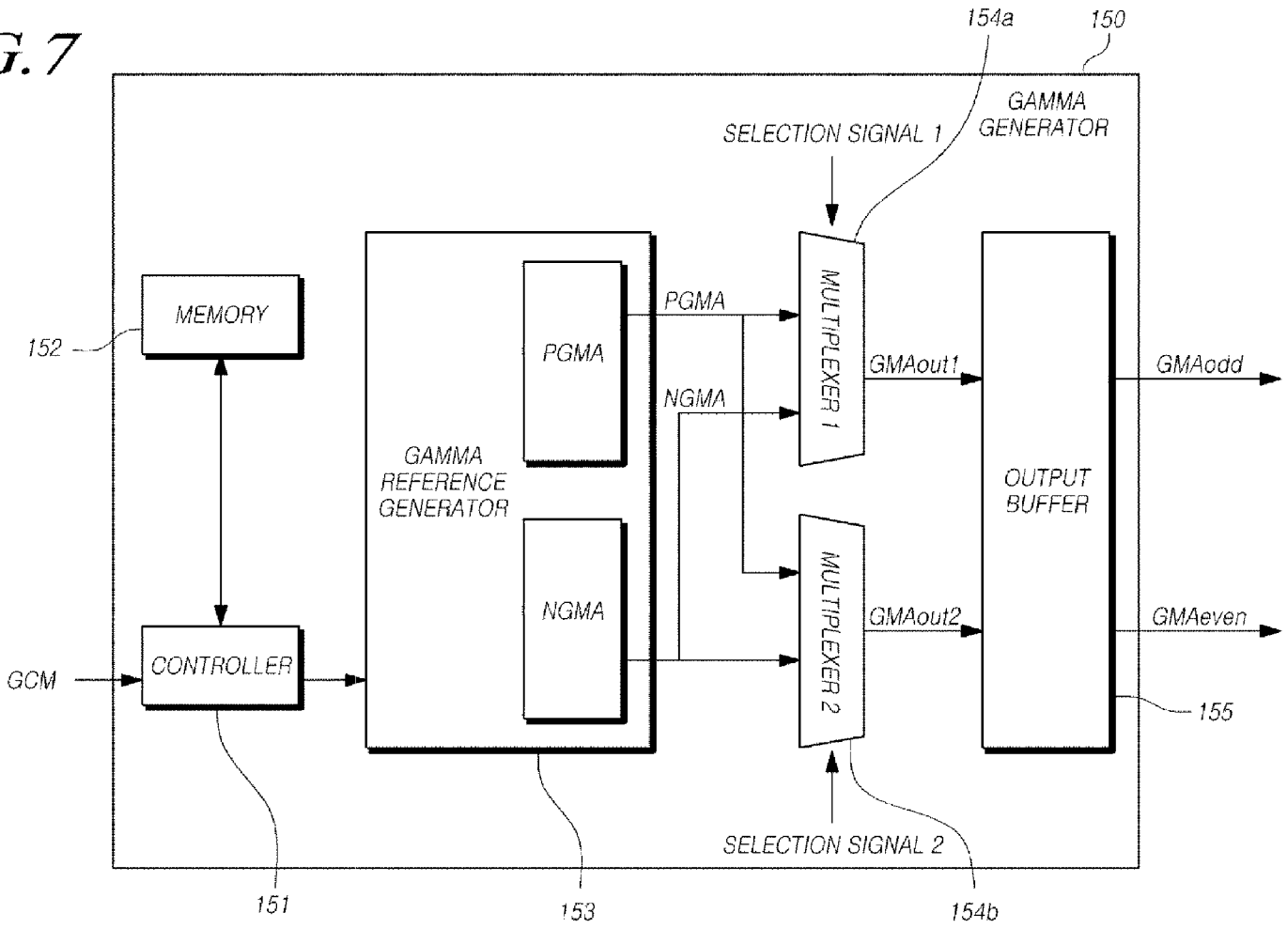
FIG. 7 illustrates a system configuration of the gamma generator according to one embodiment.

FIG. 7 illustrates a system configuration of the gamma generator 150 according to one embodiment.

Referring to FIG. 7, the gamma generator 150 may output any one of the positive gamma reference voltage PGMA and the negative gamma reference voltage NGMA as the odd gamma reference voltage to the data driver 120, and any one of the positive gamma reference voltage and the negative gamma reference voltage as the even gamma reference voltage to the data driver 120.

The gamma generator 150 may include a controller 151, a memory 152, a gamma reference voltage generator 153, a first multiplexer 154*a*, a second multiplexer 154*b* and an output buffer 155.

The controller 151, the memory 152, the gamma reference voltage generator 153, the first multiplexer 154*a*, the second multiplexer 154*b* and the output buffer 155 may be configured as one integrated circuit. Some of these elements may be external to the integrated circuit. For example, the controller 151, the memory 152, the gamma reference voltage generator 153, the first multiplexer 154*a*, the second multiplexer 154*b* and the output buffer 155 may be formed at one of a main PCB at which the timing controller 110 is located and the source PCB at which the data driver 120 is located. Although the first multiplexer 154*a* and the second multiplexer 154*b* are physically separated from each other as shown in FIG. 7, they may be configured as one multiplexer as one component some of which may perform the function of the first multiplexer 154*a* and the second multiplexer 154*b*.

The controller 151 may receive the gamma control signal from the timing controller 110, read data which is necessary for generating the positive gamma reference voltage PGMA and the negative gamma reference voltage NGMA from the memory 152 according to the gamma control signal and control the gamma reference generator 153.

The memory 152 may store a setting data for the gamma reference voltage which is necessary for generating the positive gamma reference voltage PGMA and the negative gamma reference voltage NGMA according to the gamma control signal. Although the memory 152 may be disposed inside the gamma generator 150 as shown in FIG. 7, it may be a memory inside or outside the timing controller 110 such as a EEPROM.

The gamma generator 150 may generate the positive gamma reference voltage and the negative reference voltage using the power voltage applied from the power supplier 160 according to the control of the controller 151. The gamma generator 150 may generate the positive gamma reference voltage more than the common voltage Vcom and the negative reference voltage less than that as shown in Table 1 by a voltage division scheme or a voltage divider using resistors connected in series.

TABLE 1

| positive gamma Reference voltage (PGMA) | | | | | | | | |
|---|---|---|---|---|---|---|---|---|
| GMA1 | GMA2 | GMA3 | GMA4 | GMA5 | GMA6 | GMA7 | GMA8 | GMA9 |
| negative gamma Reference voltage (NGMA) | | | | | | | | |
| GMA10 | GM111 | GMA12 | GMA13 | GMA14 | GMA15 | GMA16 | GMA17 | GMA18 |

The first multiplexer 154*a* and the second multiplexer 154*b* may be formed external to the gamma generator 150, for example, on one of a main PCB at which the timing controller 110 is located and the source PCB at which the data driver 120 is located. In other words, the gamma generator 150 and the data driver 120 as shown in FIG. 6, as they are may be used while the first multiplexer 154*a* and the second multiplexer 154*b*, may be further formed on either the main PCB or the source PCB. In other words, the controller 151, the memory 152, the gamma reference voltage generator 153 and the output buffer 155 may be included in the gamma generator 150, while the first multiplexer 154*a*, the second multiplexer 154*b* may be disposed on either the main PCB or the source PCB.

The first multiplexer 154*a* may receive the positive gamma reference voltage PGMA and the negative gamma reference voltage NGMA output from the gamma reference voltage generator 153. The first multiplexer 154*a* may output any one of the positive reference voltage and the negative reference voltage as the odd gamma reference voltage to one of the odd DACs through the output buffer 155 according to one of the gamma control signal of the timing controller such as a selection signal S1.

The second multiplexer 154*b* may receive the positive gamma reference voltage PGMA and the negative gamma reference voltage NGMA output from the gamma reference voltage generator 153. The second multiplexer 154*b* may output any one of the positive reference voltage and the negative reference voltage as the odd gamma reference voltage to one of the odd DACs through the output buffer 155 according to one of the gamma control signal of the timing controller such as a selection signal S2.

Figure 8:
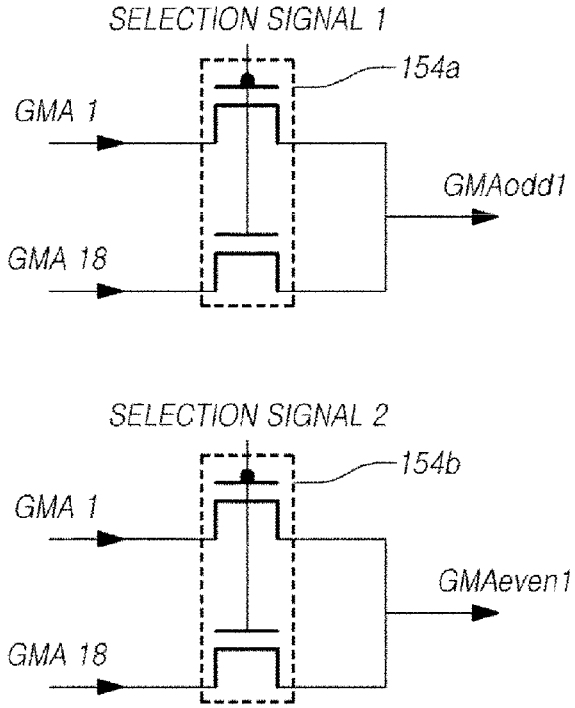
FIG. 8 illustrates an operation on some elements of the multiplexers 1 and 2.

FIG. 8 illustrates an operation on some elements of the multiplexers 1 and 2.

Referring to FIG. 8, the first multiplexer 154*a* may include a circuit group consisting of a N-type transistor and a P-type transistor. The second multiplexer 154*b* may also include a circuit group consisting of a N-type transistor and a P-type transistor.

For example, one of the positive reference voltages PGMAs such as GMA1 may be input to an input end of the N-type transistor in the first multiplexer 154*a*. One of the negative reference voltages NGMAs such as GMA18 may be input to an input end of the P-type transistor in the first multiplexer 154*a*. Output ends of the N-type transistor and the P-type transistor are commonly connected and the common output end outputs the odd gamma reference voltage GMAodd 1 to the output buffer 155. The same selection signal S1 is commonly input to gates of the N-type transistor and the P-type transistor.

Similarly one of the positive reference voltages PGMAs such as GMA1 may be input to an input end of the N-type transistor in the second multiplexer 154*b*. One of the negative reference voltages NGMAs such as GMA18 may be input to an input end of the P-type transistor in the first multiplexer 154*b*. Output ends of the N-type transistor and the P-type transistor are commonly connected and the common output end outputs the even gamma reference voltage GMAeven 1 to the output buffer 155. The same selection signal S2 is commonly input to gates of the N-type transistor and the P-type transistor.

In other words, the first multiplexer 154*a* and the second multiplexer 154*b* may output any one of the positive gamma reference voltage and the negative gamma reference voltage as the odd gamma reference voltage and the even gamma reference voltage to the DAC part 121 according to the values of the selection signals S1 and S2 as described in Table 2.

TABLE 2

| S1 | S2 | GMAeven | GMAodd |
|---|---|---|---|
| 0 | 0 | NGMA | NGMA |
| 0 | 1 | NGMA | PGMA |
| 1 | 0 | PGMA | NGMA |
| 1 | 1 | PGMA | PGMA |

The odd DACs and the even DACs of the data driver 120 may convert the digital video data into the data voltages Vout1, Vout3, Vout5, . . . , Voutn−1, Vout2, Vout4, Vout6, . . . , Voutn using the odd gamma reference voltage GMAodd and the even gamma reference voltage GMAeven selected to one of the positive gamma reference voltage and the negative gamma reference voltage, which are supplied to the odd data lines DL1, DL3, . . . DLn−1 and the even data lines DL2, DL4, . . . , DLn respectively.

As presented in Table 2, the liquid crystal display device 100 may configure either the dot inversion or column inversion of the liquid crystal according to the change of the values of the selection signals (S1, S2) such as (0, 1)→(1, 0)→(0, 1) and the like. Similarly the liquid crystal display device 100 may configure either the frame inversion of the liquid crystal according to the change of the values of the selection signals (S1, S2) such as (0, 0)→(1, 1)→(0, 0) and the like.

When the liquid crystal display panel 140 needs to display the image with the excellent image quality, the timing controller 110 supplies the values of the selection signals (S1, S2) in series such as (0, 1)→(1, 0)→(0, 1) and the like to the first multiplexer 154*a* and the second multiplexer 154*b* to configure either the dot inversion or column inversion of the liquid crystal as shown in FIGS. 3 and 4. When the liquid crystal display panel 140 needs to decrease the power consumption of the liquid crystal display device, the timing controller supplies the values of the selection signals (S1, S2) in series such as (0, 0)→(1, 1)→(0, 0) and the like to the first multiplexer 154*a* and the second multiplexer 154*b* to configure the frame inversion of the liquid crystal as shown in FIG. 5.

It is described above that the input ends of the N type transistors of the first multiplexer 154*a* and the second multiplexer 154*b* are applied to the gamma reference voltages of the same polarity and the input ends of the P type transistors of them are also applied to the gamma reference voltages of the same polarity so that the output ends of them may output the gamma reference voltages of the same polarity when the selection signals (S1, S2) are equal to each other. However the input ends of the N type transistors of the first multiplexer 154*a* and the second multiplexer 154*b* may be applied to the gamma reference voltages of the different polarities from each other. For example, the input ends of the N type transistors of the first multiplexer 154*a* and the second multiplexer 154*b* may be applied to the gamma reference voltages of the different polarities from each other. The input ends of the P type transistors of the first multiplexer 154*a* and the second multiplexer 154*b* may be also applied to the gamma reference voltages of the different polarities from each other.

In this case, the first multiplexer 154*a* and the second multiplexer 154*b* may output any one of the positive gamma reference voltage and the negative gamma reference voltage as the odd gamma reference voltage and the even gamma reference voltage to the DAC part 121 according to the values of the selection signals S1 and S2 as described in Table 3.

TABLE 3

| S1 | S2 | GMAeven | GMAodd |
|---|---|---|---|
| 0 | 0 | NGMA | NGMA |
| 0 | 1 | NGMA | PGMA |
| 1 | 0 | PGMA | NGMA |
| 1 | 1 | PGMA | PGMA |

The timing controller 110 supplies the values of the selection signals (S1, S2) in series such as (0, 1)→(1, 0)→(0, 1) and the like to the first multiplexer 154*a* and the second multiplexer 154*b* to configure the frame inversion of the liquid crystal as shown in FIG. 5. When the liquid crystal display panel 140 needs to decrease the power consumption of the liquid crystal display device, the timing controller supplies the values of the selection signals (S1, S2) in series such as (0, 0)→(1, 1)→(0, 0) and the like to the first multiplexer 154*a* and the second multiplexer 154*b* to configure either the dot inversion or column inversion of the liquid crystal as shown in FIGS. 3 and 4.

Accordingly the liquid crystal display device 110 can switch the polarity inversion scheme between the dot/column inversion and the frame inversion according to the change of the values of the selection signals.

Figure 9:
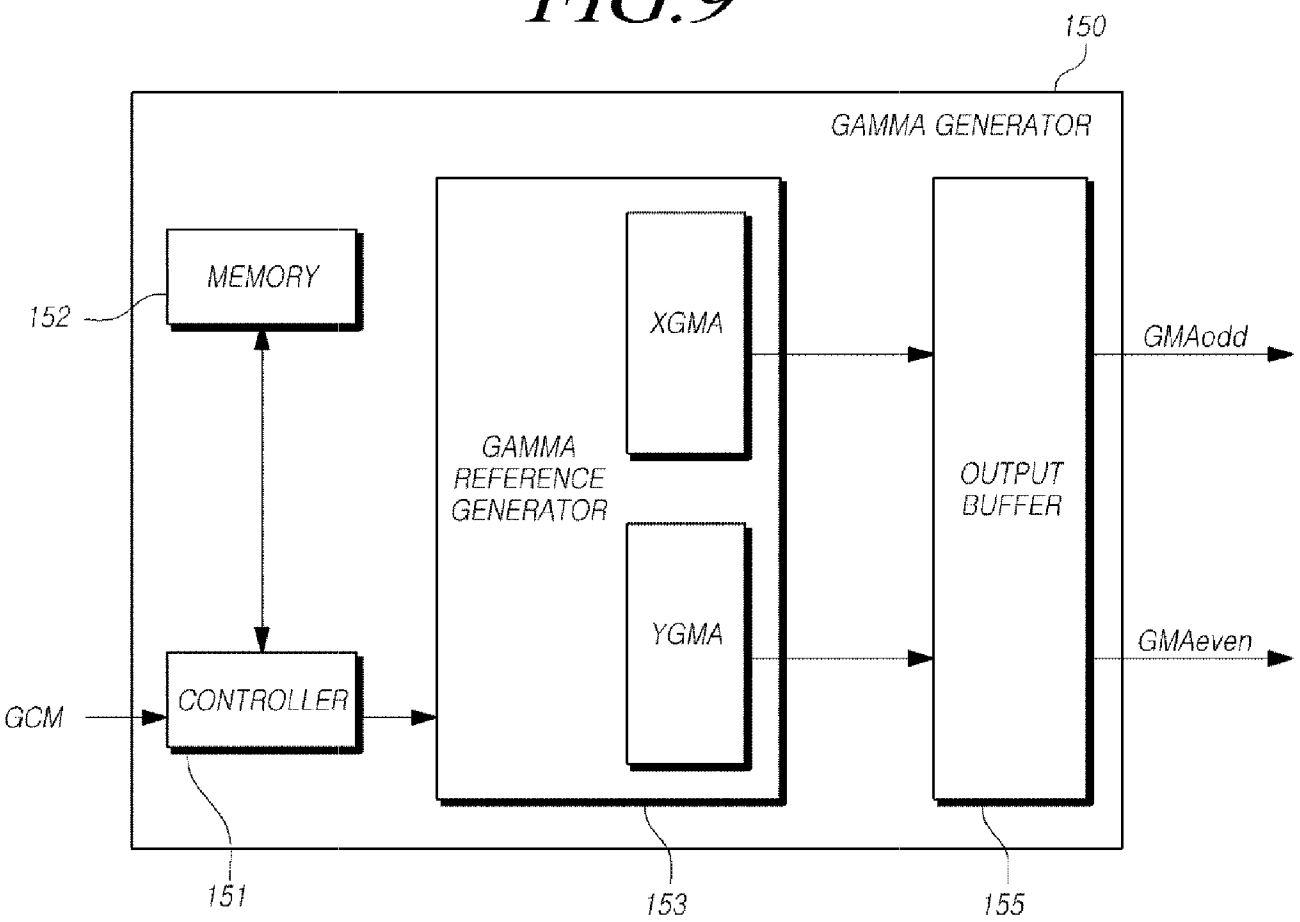
FIG. 9 illustrates a system configuration of the gamma generator according to the other embodiment.

FIG. 9 illustrates a system configuration of the gamma generator according to the other embodiment.

ent from each other according to the changeable setting data for the gamma reference voltage. The gamma generator 150 outputs the first gamma reference voltage to the data driver 120 as the odd gamma reference voltage. The gamma generator 150 outputs the second gamma reference voltage to the data driver 120 as the even gamma reference voltage.

The gamma generator 150 may include the controller 151, the memory 152, the gamma reference voltage generator 153 and the output buffer 155. The gamma generator 150 according to the other embodiment as shown in FIG. 9 is equal to that according to one embodiment as shown in FIG. 7 except for not including the first multiplexer 154*a* and the second multiplexer 154*b* in view of the system configuration.

The controller 151 may receive the gamma control signal from the timing controller 110, read data which is necessary for generating the first gamma reference voltage XGMA and the second gamma reference voltage YGMA from the memory 152 according to the gamma control signal and control the gamma reference generator 153. The controller 151 may perform communication function such as I2C serial communication to receive and transmit the gamma control signal from/to the timing controller 110.

The memory 152 may store the setting data for the gamma reference voltage which is necessary for generating the first gamma reference voltage XGMA and the second gamma reference voltage YGMA.

The gamma generator 150 may generate the first gamma reference voltage XGMA and the second gamma reference voltage YGMA using the power voltage applied from the power supplier 160 according to the control of the controller 151.

The output buffer 155 may output the first gamma reference voltage XGMA supplied from the gamma reference voltage generator 153 to the odd DACs as the odd gamma reference voltage GMAodd. The output buffer 155 may output the second gamma reference voltage YGMA supplied from the gamma reference voltage generator 153 to the even DACs as the even gamma reference voltage GMAeven.

The memory 152 may store the setting data for the gamma reference voltage which is necessary for generating the first gamma reference voltage XGMA and the second gamma reference voltage YGMA which the gamma reference generator 153 generates in the N-th frame (N is the natural number more than 1) and the N+1-th frame. The memory 152 may be a volatile memory in which the stored setting data for the gamma reference voltage can be changed.

For example, the setting data for the gamma reference voltage stored in the memory 152 such as the volatile memory may be equal to the Table 4.

TABLE 4

| | First gamma reference voltage(XGMA) | | | | | | | | |
|---|---|---|---|---|---|---|---|---|---|
| Frame | V1 | V2 | V3 | V4 | V5 | V6 | V7 | V8 | V9 |
| Odd | GMA1 | GMA2 | GMA3 | GMA4 | GMA5 | GMA6 | GMA7 | GMA8 | GMA9 |
| even | GMA18 | GMA17 | GMA16 | GMA15 | GMA14 | GMA13 | GMA12 | GMA11 | GMA10 |
| | Second gamma reference voltage(YGMA) | | | | | | | | |
| Frame | V10 | V11 | V12 | V13 | V14 | V15 | V16 | V17 | V18 |
| Odd | GMA10 | GMA11 | GMA12 | GMA13 | GMA14 | GMA15 | GMA16 | GMA17 | GMA18 |
| even | GMA9 | GMA8 | GMA7 | GMA6 | GMA5 | GMA4 | GMA3 | GMA2 | GMA` |

Referring to FIG. 9, the gamma generator 150 may generate a first gamma reference voltage XGMA and a second gamma reference voltage YGMA equal to or differ- Referring to table 4, the gamma generator 150 may generate the positive gamma reference voltage using the power voltage applied from the power supplier 160 as the first gamma reference voltage in the odd frame. The gamma generator 150 may generate the negative gamma reference voltage using the power voltage applied from the power supplier 160 as the second gamma reference voltage in the same odd frame. As mention above, the output buffer 155 may output the positive gamma reference voltage supplied from the gamma reference voltage generator 153 to the odd DACs as the first gamma reference voltage. The output buffer 155 may output the negative gamma reference voltage supplied from the gamma reference voltage generator 153 to the even DACs as the second gamma reference voltage.

The gamma generator 150 may generate the negative gamma reference voltage as the first gamma reference voltage in the even frame. The gamma generator 150 may generate the positive gamma reference voltage as the second gamma reference voltage in the same even frame. The output buffer 155 may output the negative gamma reference voltage supplied from the gamma reference voltage generator 153 to the odd DACs as the first gamma reference voltage. The output buffer 155 may output the positive gamma reference voltage supplied from the gamma reference voltage generator 153 to the even DACs as the second gamma reference voltage.

If the first gamma reference voltage XGMA and the second gamma reference voltage YGMA stored in the memory 152 are equal t to the table 4, the liquid crystal display device 100 can drive the dot/column inversion.

The setting data for the gamma reference voltage stored in the memory 152 may be changeable as shown in the Table 5 below according to the control signal of the timing controller. The control signal of the timing controller may be a control signal generated per one frame such as one of the polarity signal POL and the vertical synchronization signal Vsync.

TABLE 5

| | First gamma reference voltage(XGMA) | | | | | | | | |
|---|---|---|---|---|---|---|---|---|---|
| Frame | V1 | V2 | V3 | V4 | V5 | V6 | V7 | V8 | V9 |
| Odd | GMA1 | GMA2 | GMA3 | GMA4 | GMA5 | GMA6 | GMA7 | GMA8 | GMA9 |
| even | GMA18 | GMA17 | GMA16 | GMA15 | GMA14 | GMA13 | GMA12 | GMA11 | GMA10 |
| | Second gamma reference voltage(YGMA) | | | | | | | | |
| Frame | V10 | V11 | V12 | V13 | V14 | V15 | V16 | V17 | V18 |
| Odd | GMA9 | GMA8 | GMA7 | GMA6 | GMA5 | GMA4 | GMA3 | GMA2 | GMA1 |
| even | GMA10 | GMA11 | GMA12 | GMA13 | GMA14 | GMA15 | GMA16 | GMA17 | GMA18 |

The gamma generator 150 may generate the positive gamma reference voltage as the first gamma reference voltage and the second gamma reference voltage in the odd frame. The gamma generator 150 may generate the negative gamma reference voltage as the first gamma reference voltage and the second gamma reference voltage in the even frame.

If the first gamma reference voltage XGMA and the second gamma reference voltage YGMA stored in the memory 152 are equal t to the table 5, the liquid crystal display device 100 can drive the frame inversion.

The timing controller 110 can directly change the setting data for the gamma reference voltage necessary for generating the first gamma reference voltage XGMA and the second gamma reference voltage YGMA stored in the memory 152 through the serial communication such as I2C. The timing controller 110 can perform the serial communication with the controller 151 of the gamma generator 150 so that the timing controller 110 can indirectly change the setting data for this gamma reference voltage stored in the memory 152 through the controller 151 thereof. When the memory uses the memory inside or outside the timing controller 110 such as the EEPROM, the timing controller 110 can change the setting data for the gamma reference voltage stored in the EEPROM.

Although it is described in the above embodiments that the timing controller 110 changes the setting data for the gamma reference voltage stored in the memory 152 through the control signal, the controller 151 may change the setting data for the gamma reference voltage stored in the memory 152 either in reference with the control signal of the timing controller 110 such as the polarity signal POL and the vertical synchronization signal Vsync, or using an external device such as a processor regardless of the control signal of the timing controller 110.

The setting data for the gamma reference voltage may be changed in real time. The setting data for the gamma reference voltage may be also changed in a vertical blank interval between the frames considering the image quality change and the communication speed of the I2C when changed in real time. In the latter case, the user can not know the image quality change.

If the number of the packet data in the I2C communication in order to change the setting data for the gamma reference voltage is 36, the number of the gamma reference voltages is 6, the number of the common voltages is 7 and the speed of the I2C communication is 400 Khz (1/400,000 second), the time necessary for change the setting data is 36×7×1/400,000=630 us and the interval of the vertical blank interval is the horizontal period×the number of the horizontal lines (the number of the gate lines)×the frequency of LVDS clock×45×1/750000000=1320 us.

The mentioned embodiment above changes the stored setting data for the gamma reference voltage as the table 4 into that as the table 5 in the vertical blank interval so that either the dot/column inversion or the frame inversion may be selectively configured.

Although the mentioned embodiment above changes the stored setting data for the gamma reference voltage as the table 4 into that as the table 5, it may change the latter into the former reversely. After the plurality of setting data for the gamma reference voltage of both table 3 and the table 4 are stored in the memory, one of them may be selected using either the control signal or the external device as mentioned above so that either the dot/column inversion or the frame inversion may be selectively configured.

One embodiment adds the multiplexer to the gamma generator 150 without changing the previous components, and the other embodiment uses the gamma generator 150 as it is and changes the setting data for the gamma reference stored in the memory between the table 4 and the table 5 so that the frame inversion may be configured without resigning the circuit, without the additional cost or with the minimized additional cost.

Therefore the various embodiments can configure the frame inversion as well as the dot/column inversion with decreasing the power consumption.

Although the various embodiments is described above in reference with the drawings, the present inventions is not limited thereto.

For example, the mentioned embodiments describes the liquid crystal display device as the display device, they includes any types of the display device to invert the polarity per the frame with the mentioned inversion scheme above.

While the technical spirit of the present invention has been exemplarily described with reference to the accompanying drawings, it will be understood by a person skilled in the art that the present invention may be varied and modified in various forms without departing from the scope of the present invention. Therefore, the embodiments disclosed in the present invention are intended to illustrate the scope of the technical idea of the present invention, and the scope of the present invention is not limited by the embodiment. The scope of the present invention shall be construed on the basis of the accompanying claims in such a manner that all of the technical ideas included within the scope equivalent to the claims belong to the present invention.

What is claimed is:

1. A display device comprising:

a display panel having a plurality of data lines and gate lines crossing in a matrix form, wherein a pixel is defined at each crossing thereof;

a data driver connected to the plurality of data lines and supplying analog data voltages converted from digital data voltages to odd data lines and even data lines respectively according to an odd gamma reference voltage and an even gamma reference voltage;

a gamma generator outputting one of a positive gamma reference voltage and a negative gamma reference voltage as the odd gamma reference voltage, and one of the positive gamma reference voltage and the negative gamma reference voltage as the even gamma reference voltage to the data driver; and a timing controller generating a control signal for driving the display panel which comprises a selection signal to select one of the positive gamma reference voltage and the negative gamma reference voltage at the gamma generator wherein the gamma generator comprises a gamma reference voltage generator for generating the positive gamma reference voltage and the negative gamma reference voltage, wherein the gamma reference voltage generator applies the positive gamma reference voltage and the negative gamma reference voltage to a multiplexer of the gamma generator, and wherein the multiplexer outputs any one of the positive gamma reference voltage and the negative gamma reference voltage as the odd gamma reference voltage and any one of the positive gamma reference voltage and the negative gamma reference voltage as the even gamma reference voltage to an output buffer connected to the odd data line and the even data line, respectively.

2. The display device as claimed in claim 1, wherein the display panel performs a polarity inversion according to a value of the selection signal.

3. The display device as claimed in claim 2, wherein the multiplexer selects one of the positive gamma reference voltage and the negative gamma reference voltage according to the selection signal.

4. The display device as claimed in claim 3, further comprising a main printed circuit board (PCB) at which the timing controller is located and a source PCB at which the data driver is located, wherein the multiplexer is formed at one of the main PCB and the source PCB.

5. A display device comprising:

a display panel having a plurality of data lines and gate lines crossing in a matrix form, wherein a pixel is defined at each crossing thereof;

a data driver connected to the plurality of data lines and supplying analog data voltages converted from digital data voltages into odd data lines and even data lines respectively according to an odd gamma reference voltage and an even gamma reference voltage;

a gamma generator generating a first gamma reference voltage and a second gamma reference voltage equal to or different from each other as a gamma reference voltage according to setting data for the gamma reference voltage and outputting the first gamma reference voltage and the second gamma reference voltage to an output buffer, wherein the output buffer outputs the first gamma reference voltage as the odd gamma reference voltage, and outputs the second gamma reference voltage as the even gamma reference voltage; and a timing controller generating a control signal for driving the display panel.

6. The display device as claimed in claim 5, further comprising a memory for storing the setting data for the gamma reference voltage for generating the first gamma reference voltage and the second gamma reference voltage, wherein the memory is located in one of the gamma generator and the timing controller.

7. The display device as claimed in claim 6, wherein the memory is a volatile memory.

8. The display device as claimed in claim 6, wherein the control signal comprises a polarity control signal and a vertical synchronization signal by one of which the setting data for the gamma reference voltage stored in the memory is converted.

9. The display device as claimed in claim 6, wherein the setting data for the gamma reference voltage stored in the memory is converted in a vertical blank interval.

* * * * *